United States Patent [19]

Sanders et al.

[11] Patent Number: 4,687,965

[45] Date of Patent: Aug. 18, 1987

[54] CAPPED ELECTRIC LAMP

[75] Inventors: Rudolf Sanders; Godefridus G. van Seggelen, both of Eindhoven, Netherlands

[73] Assignee: U.S. Philips Corporation, New York, N.Y.

[21] Appl. No.: 722,635

[22] Filed: Apr. 12, 1985

[30] Foreign Application Priority Data

Mar. 7, 1985 [NL] Netherlands ..... 8500644

[51] Int. Cl.[4] ..... H01J 5/48; H01J 5/50

[52] U.S. Cl. ..... 313/318; 362/211; 362/267; 362/362; 439/617

[58] Field of Search ..... 313/318, 49, 51; 339/210 T, 218 L, 220 L, 221 L, 75 A, 220 T, 275 B, 278 T; 362/211, 296, 362, 267, 375

[56] References Cited

U.S. PATENT DOCUMENTS

| | | | |
|---|---|---|---|
| 3,808,581 | 4/1974 | Murray | 339/210 T |
| 4,119,877 | 10/1978 | Grewe et al. | 313/318 |
| 4,199,212 | 4/1980 | Baldyga | 339/210 T |
| 4,396,860 | 8/1983 | Hellwig et al. | 339/144 R |
| 4,412,273 | 10/1983 | Helbig et al. | 362/267 |
| 4,464,007 | 8/1984 | Parmer | 339/220 T |

*Primary Examiner*—David K. Moore
*Assistant Examiner*—Theodore Salindong
*Attorney, Agent, or Firm*—David R. Treacy

[57] ABSTRACT

The capped electric lamp according to the invention has a lamp cap (9) of synthetic material comprising a dish-shaped part (10) having a circular-cylindrical wall portion (11) with an axis (12) and a bottom (13), and further comprising a panel (16) in which contact members (20) are anchored and a sleeve-shaped part (17) which surrounds these contact members. There is fixed in the dish-shaped part (10) a metal sleeve (7) which is telescopically joined at one end (8) with a flanged edge (6) of a metal clamping plate (5) and is connected thereto, while a seal (2) of a lamp vessel (1) is fixed in an opening of this clamping plate. The lamp is of a simple construction that can be readily manufactured and permits of fixing an electric element (3) in a pre-determined position with respect to the lamp cap (9), which requires little space in the direction of the axis (12) because a plug-in member with connection terminals can be arranged at right angles to the axis (12), while the presence of the sleeve-shaped part (17) prevents corrosion of the contact members (20).

11 Claims, 3 Drawing Figures

CAPPED ELECTRIC LAMP

The invention relates to a capped electric lamp provided with

- a gas-filled translucent lamp vessel with a vacuum-tight seal;
- an electric element or filament inside the lamp vessel;
- current supply conductors extending through the wall of the lamp vessel to the electric element;
- a metal clamping plate having an opening in which the seal is held by lugs present on the clamping plate along the opening, said clamping plate having a substantially circular-cylindrically flanged edge;
- a substantially circular-cylindrical metal sleeve having a first and a second end, which at its first end is telescopically joined with the cylindrically flanged edge of the clamping plate and is secured thereto;
- a lamp cap of synthetic material provided with a dish-shaped part, which part has a substantially circular-cylindrical wall portion with an axis and a bottom, the second end of said metal sleeve being fixed in said dish-shaped part, which lamp cap has outside the dish-shaped part electric contact members, which are connected to a respective current supply conductor.

Such an electric lamp is known from U.S. Pat. No. 4,412,273.

The known lamp is suitable to be used as a headlamp for vehicles, in which the lamp vessel is passed through an opening in a reflector provided with a front glass. In this lamp, the electric contacts are passed through the bottom of the dish-shaped part of the lamp cap and they extend in the longitudinal direction of the cylindrical wall of this part of the lamp cap. This is a disadvantage because, consequently, in the vehicle in which the lamp is arranged in a lantern, a comparatively large amount of space is required behind this lantern for connecting a plug-in member having output terminals of a supply source to the lamp cap.

In lamps of this kind, it is of importance that the electric element has an accurately fixed position with respect to reference points on the lamp cap. Because of this, the electric element has to occupy a predetermined position in a reflector when the lamp is arranged therein. In the known lamp, the lamp bulb is rigidly fixed in the clamping plate and the clamping plate is rigidly fixed in the metal sleeve. The clamping plate is not secured to the metal sleeve until the electric element has occupied the correct position with respect to the reference points on the lamp cap. In view of the fact that in normal operation the lamp is susceptible to shocks and vibrations, the electric element can maintain its correct position only if the metal sleeve is rigidly secured to the lamp cap of synthetic material. However, the aforementioned U.S. patent specification does not give any indication about a manner in which the metal sleeve could be rigidly fixed in the lamp cap of synthetic material.

Another disadvantage of the known lamp is that the contacts at the lamp cap project into the free space below the bottom of the lamp cap, as a result of which it is difficult to avoid, after a plug-in member having output terminals of a supply source has been brought into contact with these contacts, that moisture reaches the contacts and causes contact resistances to be formed by corrosion.

The invention has for its object to provide a lamp of the kind mentioned, which is of a simple construction that can be manufactured in a simple manner, in which the metal sleeve is rigidly secured in the lamp cap of synthetic material, the contacts of the lamp cap require less space below the bottom of the dish-shaped part to connect them to a plug-in member, and means are provided by which the contacts of the lamp cap are protected against moisture during operation.

According to the invention, in an electric lamp of the kind described in the opening paragraph, this object is achieved in that

- the metal sleeve has projecting lugs which are in locking engagement with the dish-shaped part of the lamp cap of synthetic material;
- the lamp cap of synthetic material has a panel which projects below the bottom of the dish-shaped part and in which contact members are anchored, which extend at right angles to the axis of the cylindrical wall portion; and
- the contact members are surrounded by a sleeve-shaped wall portion, which is connected at one end to the panel.

The metal sleeve may have lugs, which are bent outwards from the sheath of the sleeve and which, formed as barbed hooks, are in engagement with the cylindrical wall portion of the dish-shaped part of the lamp cap. Another possibility is the provision of lugs which are arranged in line with the sheath of the metal sleeve and are in locking engagement with the bottom of the dish-shaped part. For this purpose, the bottom may be provided with recesses or openings in which lugs in the form of barbed hooks are fixed, but alternatively the lugs may be passed through such openings and be flanged on the lower side of the bottom. The term "flanged" may be understood to mean that the lugs are bent so that they engage the lower side of the bottom with their bent part or that the lugs are twisted. In a preferred embodiment, the metal sleeve has a longitudinal slot. This slot has the advantage that differences in the diameters of the metal sleeve and the dish-shaped part of the lamp cap can be readily neutralized and that nevertheless the sleeve can laterally bear on this part. A further advantage is that the metal sleeve can be made of plate material and nevertheless need not be provided with a longitudinal seam.

A still further possibility consists in that the metal sleeve is embedded with its lugs in the synthetic material during the manufacture of the lamp cap. It should then be noted that the sleeve need not be aligned in a mold because the sub-unit of metal sleeve and lamp cap still leaves the necessary freedom of positioning the lamp vessel.

The constructional feature of the lamp according to the invention is simple and is also efficient.

The panel projecting below the bottom of the dish-shaped part of the lamp cap provides the possibility of securing contact members to the lamp cap in a manner such that they extend at right angles to the axis of the cylindrical wall portion of the dish-shaped part. Thus, a smaller amount of space is required below the bottom of the dish-shaped part in the direction of the axis of the cylindrical wall portion to provide a plug-in member with output terminals of a supply source than if the contact members should extend along this axis.

The contact members may be anchored in openings in the panel, for example by means of barbed hooks at these members and/or of resilient tongues. The contact members may alternatively be partly embedded in the synthetic material during the manufacture of the lamp cap.

The sleeve-shaped wall portion, which is connected at one end to the panel, provides a substantial sheathing of the contact members from moisture if a plug-in member with output terminals of a supply source is mounted. The extent of sheathing depends upon the fit of this plug-in member. However, even with a poor fit, the creepage path for moisture is considerably longer than in the absence of the sleeve-shaped wall portion.

In a preferred embodiment, the contact members extend as far as below the bottom of the dish-shaped part of the lamp cap. In a variation thereof, they are rectangularly bent below this bottom. In both configurations, a rib may be present on the part located below this bottom, this rib extending, for example, at right angles to the axis of the cylindrical wall portion. The current supply conductors can then very readily be welded to a respective contact member.

If desired, the space bounded by the bottom of the dish-shaped part and by the panel may be closed by a cover. A very attractive embodiment is that in which the cover and lamp cap have cooperating grooves and protrusions which hold the cover. In this case, the cover may be locked against displacement by a snap connection. Alternatively, the cover may be fixed solely by snap connections, be glued to the lamp cap or be connected to the lamp cap by ultrasonic means. If desired, an opening may be provided, through which the space closed by the cover is filled with a synthetic (foam) material.

The electric element in the lamp vessel may be a filament or an electrode pair, but two filaments, for example one for a main beam and one for a dipped beam are also possible.

It should be noted that a reliable positioning of the electric element with respect to reference points on the lamp cap, transversely extending contact members, and a sleeve-shaped wall portion of a lamp cap enveloping these members could also be obtained in an other manner. The contact members could be connected to the current supply conductors of a lamp by means of a flexible cord and the assembly could be embedded in synthetic material. For this purpose, however, these contact members would have to be positioned in a mold and the electric element would have to be aligned with respect to the mold. Consequently, in order to be able to manufacture a capped lamp in this manner, complicated equipment is required. Moreover, for each lamp this equipment would be occupied for a long time due to the alignment and due to the fact that a solid lamp cap is obtained so that the mold would have to remain closed for a long time to permit the large mass of synthetic material of solidifying sufficiently.

Embodiments of the lamp according to the invention are shown in the drawing. In the drawing.

Figure 1:
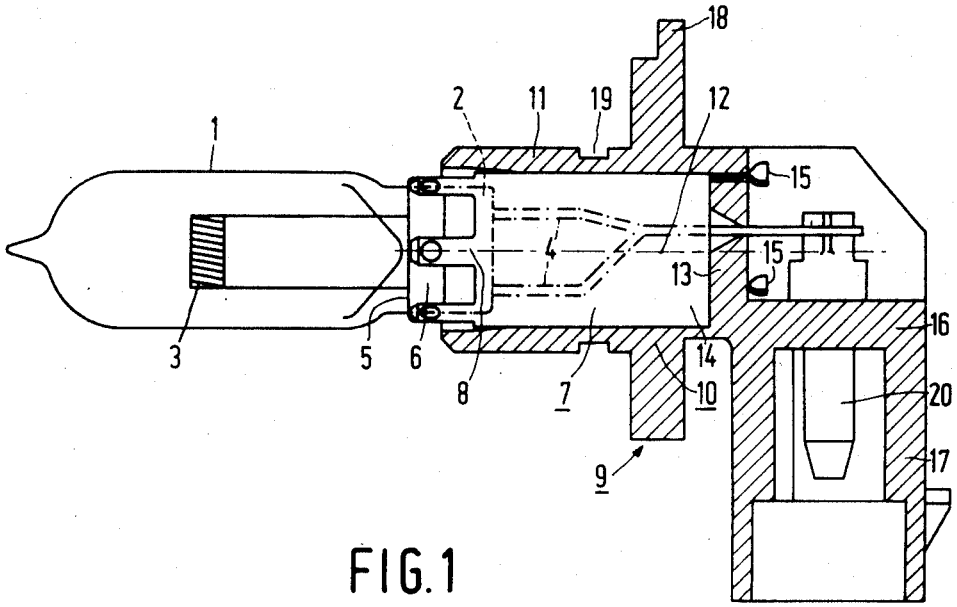
FIG. 1 is a side elevation of a first embodiment with a lamp cap in longitudinal sectional view.

In FIG. 1, the lamp has a lamp vessel 1 of hard glass or quartz glass, which is filled with gas and has a vacuum-tight seal 2. A filament 3 is arranged as an electric element inside the lamp vessel and connected to current supply conductors 4 passed through the wall of the lamp vessel 1. A metal clamping plate 5 has an opening, in which the seal 2 of the lamp vessel is held by lugs present along this opening. Such a plate is known from U.S. Pat. No. 4,119,877. The clamping plate 5 has a substantially circular-cylindrically flanged edge 6. This edge 6 is joined telescopically with the first end 8 of a substantially circular-cylindrical sleeve 7 and is secured to this end by welding.

A lamp cap 9 of synthetic material has a dish-shaped part 10 comprising a substantially circular-cylindrical wall portion 11 with an axis 12 and a bottom 13, the metal sleeve 7 being fixed in this dish-shaped part 10 with its second end 14. The lamp cap 9 has contact members 20 located outside the dish-shaped part 10.

The metal sleeve 7 has projecting lugs 15 which are in locking engagement with the dish-shaped part of the lamp cap 9 of synthetic material. In the figure they are passed through the bottom 13 and are twisted below the bottom.

The lamp cap 9 has a panel 16, which projects below the bottom 13 of the dish-shaped part 10. The contact members 20 are anchored in this panel 16 and extend at right angles to the axis 12 of the cylindrical wall portion 11.

The contact members 20 are surrounded by a sleeve-shaped wall portion 17 of the lamp cap 9, which is connected at one end to the panel 16.

The lamp cap 9 is provided with a profiled collar 18, which, when arranged in a reflector, ensures the correct positioning of the lamp cap. A groove 19 is adapted to receive an O-ring for closing the cavity in a reflector when the lamp is arranged.

Figure 2:
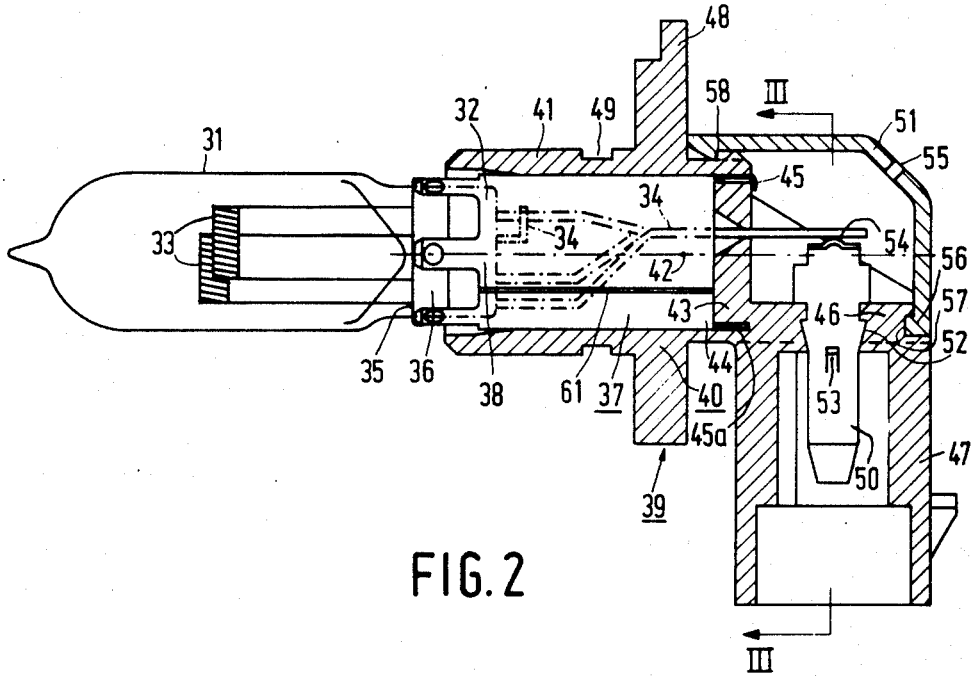
FIG. 2 shows a second embodiment in a similar position.

In FIG. 2, parts corresponding to parts in FIG. 1 have a reference numeral which is 30 higher. The lamp shown has as its electric element two filaments 33. Two of the current supply conductors 34 are directly connected to each other so that the lamp has three contact members 50.

The metal sleeve 37 has a longitudinal slot 61. If the sleeve has a larger diameter than the cylindrical wall portion 41 and has a comparatively wide slot 61, the sleeve 37 can readily be introduced into the wall portion 41 by making the diameter of the sleeve temporarily smaller than that of this wall portion. After the introduction, the sleeve 37 springs back to its original size, as a result of which the sleeve engages the cylindrical portion 41. The sleeve 37 has a lug 45 which is bent below the bottom 43 and thus locks the sleeve not only against rotation, but also against translation. Furthermore, a lug **45*a* is present, which is provided with barbed hooks which engage a recess of the bottom 43**.

The contact members 50 are introduced through openings in the panel 46 into the sleeve-shaped wall portion 47. Barbed hooks 52 and resilient tongues 53 fix the contact members 50. The contact members have a bent portion provided with a rib 54, on which a welding connection with a current supply conductor 34 is established.

The space bounded by the bottom 43 and the panel 46 is closed by a cover 51. Cooperating protrusions 56 and groove 57 hold the cover in place. The cover is fixed by a snap connection 58. Through an opening 55 in the cover 51, the closed space can be filled, for example, with synthetic foam material. Due to the presence of the cover 51, no mold is required in this lamp to fill the space with synthetic material. By the use of foam material, a filling and a sealing of openings and seams are obtained, which means only a very small increase in weight.

Figure 3:
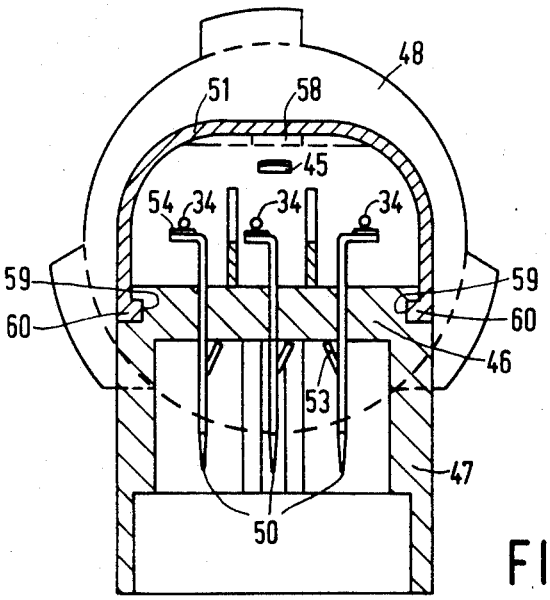
FIG. 3 is a sectional view taken on III—III in FIG. 2.

In FIG. 3, further cooperating grooves 59 and protrusions 60 are visible.

The lamp can be manufactured in a simple manner. The sleeve 37 of, for example, chromium steel is provided in the lamp cap 39 of, for example, polyphenylene sulphide or polyamide. Its lugs 45 are bent. The contact members 50 are pressed into the panel 46.

Subsequently, the lamp vessel 31 has its seal 32 disposed in the clamping plate 35, which is made of, for example, new silver (an alloy of copper, nickel and zinc). The sleeve 37 telescopically surrounds the flanged edge 36 of the clamping plate 35. A filament is then energized and optical images thereof are brought into a pre-determined tolerance range, as a result of which this filament is brought into a predetermined position with respect to reference points on the lamp cap 39. Thereafter, welding connections are established between the flanged edge 36 and the sleeve 37. Thus, the position of the electric element is fixed.

Finally, the welding connections between the current supply conductors 34 and the contact members 50 are established, the cover 51 is provided and fixed by the snap connection 58 and, as the case may be, the space thus enclosed is filled with synthetic material. Thus, a lamp is finished, which satisfies the object aimed at by the invention.

What is claimed is:

1. A capped electric lamp comprising:

(a) a gas filled translucent lamp vessel having a wall and a vacuum-tight seal;

(b) an electric element arranged inside said lamp vessel;

(c) current supply conductors extending through said wall of said lamp vessel and connected to said electric element;

(d) a metal clamping plate having an opening and lugs projecting along said opening, said seal of said lamp vessel firmly fixed within said opening by said lugs, said clamping plate having a substantially circular-cylindrical flanged edge;

(e) a substantially circular-cylindrical metal sleeve having a first and a second end, said first end being telescopically joined with said flanged edge of said clamping plate and secured thereto;

(f) a lamp cap made of synthetic material and having a dish-shaped part, said dish-shaped part having a substantially circular-cylindrical wall portion with an axis and a bottom, said second end of said metal sleeve being fixed in said dish-shaped part;

(g) conducting contact members electrically coupled to said current supply conductors; and (h) the improvement therein comprising (i) lugs projecting from said metal sleeve for engaging said dish-shaped part of said lamp cap;

(ii) a panel projecting downwardly from said bottom of said dish-shaped part of said lamp cap;

(iii) a sleeve-shaped wall portion connecting to said panel and extending at a right angle to said axis of said cylindrical wall portion of said lamp cap; and (iv) said contact members being anchored in said panel, said contact members being extended at right angles to said axis of said cylindrical wall part of said lamp cap and surrounded by said sleeve-shaped wall portion.

2. A capped electric lamp as claimed in claim 1, characterized in that the lugs of the metal sleeve are arranged in line with said sleeve and are in engagement with the bottom of the dish-shaped part of the lamp cap.

3. A capped electric lamp as claimed in claim 2, characterized in that the lugs are flanged below the bottom.

4. A capped electric lamp as claimed in claim 2, characterized in that the metal sleeve has a longitudinal slot.

5. A capped electric lamp as claimed in claim 1, characterized in that the contact members are anchored by means of barbed hooks said panel.

6. A capped electric lamp as claimed in claim 1, characterized in that the contact members extend as far as below the bottom of the dish-shaped part of the lamp cap and have in situ a bent part provided with a rib, on which a welding connection with a respective current supply conductor is established.

7. A capped electric lamp as claimed in claim 1, characterized in that the space bounded by the bottom of the dish-shaped part of the lamp cap and by the panel is closed by a cover.

8. A capped electric lamp as claimed in claim 7, characterized in that the cover and the lamp cap have cooperating grooves and protrusions which hold the cover.

9. A capped electric lamp as claimed in claim 8, characterized in that the cover is fixed by a snap connection.

10. A capped electric lamp as claimed in claim 7, characterized in that the closed space is filled with a synthetic material.

11. A capped electric lamp as claimed in claim 1, characterized in that the metal sleeve has a longitudinal slot.

* * * * *